United States Patent [19]

Palmer

[11] Patent Number: 4,846,376

[45] Date of Patent: Jul. 11, 1989

[54] INVERSION FOAMER

[75] Inventor: Darrel Palmer, Sandy, Utah

[73] Assignee: Ballard Medical Products, Midvale, Utah

[21] Appl. No.: 160,365

[22] Filed: Feb. 25, 1988

[51] Int. Cl.[4] ..... B67D 5/58

[52] U.S. Cl. ..... 222/190; 222/211; 222/481

[58] Field of Search ..... 222/190, 206, 207, 209, 222/210, 211, 212, 394, 401, 464, 478, 481, 481.5, 564; 239/327, 339, 343, 344, 345, 347; 137/600

[56] References Cited

U.S. PATENT DOCUMENTS

| | | | |
|---|---|---|---|
| 3,422,993 | 1/1969 | Boehm | 222/190 |
| 3,622,049 | 11/1971 | Thompson | 222/190 |
| 3,709,437 | 1/1973 | Wright | 239/343 |
| 4,024,992 | 5/1977 | Schmid | 222/211 |
| 4,087,024 | 5/1978 | Martin et al. | 222/211 |
| 4,093,124 | 6/1978 | Morane et al. | 239/327 |
| 4,531,659 | 7/1985 | Wright | 222/190 |
| 4,531,660 | 7/1985 | Ford, Jr. | 222/207 X |
| 4,596,343 | 6/1986 | Ford, Jr. | 222/190 |
| 4,640,440 | 2/1987 | Ford, Jr. et al. | 222/190 |

FOREIGN PATENT DOCUMENTS

| | | | |
|---|---|---|---|
| 278947 | 8/1988 | European Pat. Off. | 222/190 |
| 2610302 | 8/1988 | France | 222/190 |

*Primary Examiner*—Kevin P. Shaver

*Attorney, Agent, or Firm*—Lynn G. Foster

[57] ABSTRACT

A nonaerosol foamer comprised of an outer container or bottle and novel internal labyrinth structure comprising a slotted body covered along one face with a film of durable synthetic resinous material whereby separate air and liquid influent channels, a foaming site, and a separate foam effluent channel are defined. The liquid influent channel is constructed such that it allows controlled movement of the foamable liquid from the liquid reservoir to the foaming site during application of positive pressure within the outer container, while preventing siphoning of the foam. A novel film flap valve controls flow of influent air into the container to replenish air earlier used to produce foam.

10 Claims, 3 Drawing Sheets

INVERSION FOAMER

FIELD OF INVENTION

This invention relates generally to nonaerosol foamers and more specifically to improvements in hand-held, nonaerosol foam dispensing devices (foamers) comprising internal labyrinth structure used in an inverted position where the foamer itself functions as an air pump.

PRIOR ART

Foam dispensing devices or nonaerosol foamers have been known in the art for several years. The following are representative of the prior art: U.S. Pat. No. 4,640,440 issued to Ford, et al.; U.S. Pat. No. 3,422,993 issued to G. L. Boehm; U.S. Pat. No. 3,709,437 issued to H. E. Wright; U.S. Pat. No. 3,622,049 issued to R. E. Thompson and U.S. Pat. No. 4,024,992 issued to Schmid. Of these patents the Ford, Boehm and Wright disclosures are believed most pertinent and show foamers which can be used in the inverted condition. Ford does not comprise a labyrinth structure, and it further uses structure increasing the complexity and decreased reliability in the manufacture and operation of the foamer. Boehm makes no specific provision for air return and Wright provides a valved air return system in the foam discharge conduit. The Thompson patent discloses a separate air return system but cannot be used in the inverted position. One other known foam dispensing device produced at one time by Ballard Medical Products, the assignee of the present invention, provides a separate air return conduit which extends into the container air space when the container is inverted. However, the foam producing structure is under liquid head during operation which leads to undesirable migration of unfoamed liquid through the spout when the device is inverted. In addition, such devices, in general, use a conventional squeeze container which is of limited effectiveness in dispensing the foam.

The present invention overcomes or substantially alleviates the above described problems of the prior art in a manner not disclosed in the known prior art.

BRIEF SUMMARY AND OBJECTS OF THE INVENTION

In brief summary, the foamer of the present invention is comprised of an outer container or bottle and a novel internal labyrinth structure defining separate air and liquid influent channels, a foaming site, and a separate foam effluent channel. The liquid influent channel is constructed such that it allows controlled movement of the foamable liquid from the liquid reservoir to the foaming site during application of positive pressure within the outer container, while preventing siphoning of the foam.

Also provided is a single orifice for direct entry of air into the foaming site which does not accommodate flow of foamable liquid into the foaming site when the foamer is in its noninverted, storage position.

A novel flap valve is interposed between the internal body and the interior of the collapsible outer container which is closed during formation and discharge of foam due to manually caused positive internal air pressure and which is opened at cessation of foam production while the internal pressure within the partially collapsed outer container is negative.

With the foregoing in mind, a principal object of the present invention is to overcome or substantially alleviate problems of the prior art by providing a novel foamer for use in a hand-actuated, inverted position.

Another significant object of the invention is to provide an improved foamer which has internal labyrinth structure and an outer collapsible container which also functions as an air pump.

A further important object of the invention is to provide an improved foamer for more reliable use and more economic manufacture.

It is another primary object of the present invention to provide a foamer comprising a simplified but highly reliable air intake valve.

These and other objects and features of the present invention will be apparent from the detailed description taken with reference to the accompanying drawings.

DETAILED DESCRIPTION OF THE ILLUSTRATED EMBODIMENT

Figure 1:
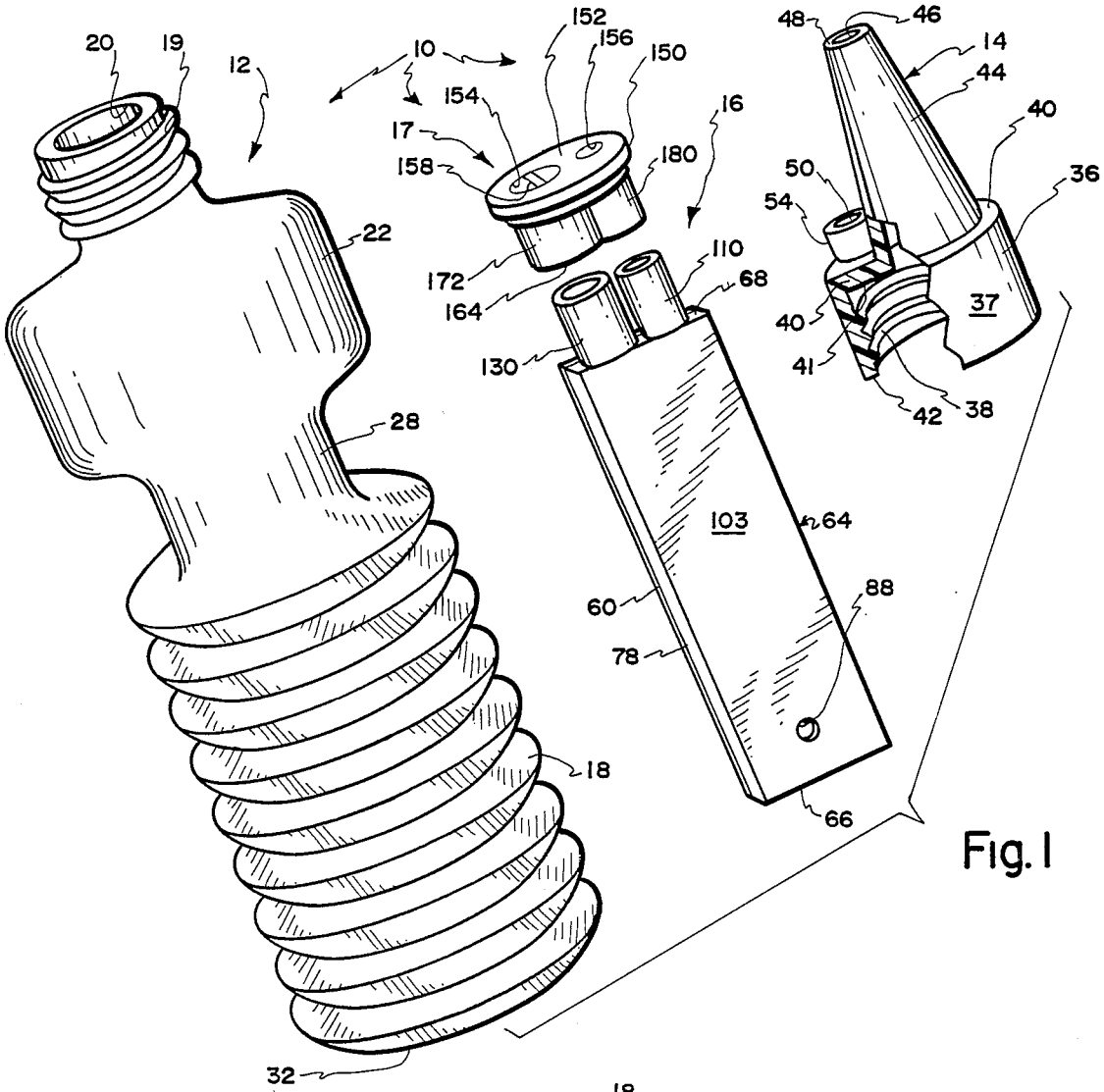
FIG. 1 is a three dimensional perspective of the disassembled major components used to form a presently preferred foamer according to the present invention, with part of the foam dispensing nozzle broken away for clarity.

Reference is now made to the drawings, wherein like numerals are used to designate like parts throughout. Specific reference is made to FIG. 2, which illustrates a presently preferred foam dispensing device (also known as a nonaerosol foamer), generally designated 10, disposed in a hand-held, inverted as-used position. The foam dispensing device 10 is comprised of an outer hollow container, generally designated 12, a foam dispensing nozzle, generally designated 14, interior labyrinth structure, generally designated 16 (FIG. 1), which accommodates valved influent air flow, foamable liquid flow and foam formation and coupling member 17. While nozzle 14 and coupling member 17 are illustrated as being separate components, they may be formed together.

The container 12 is preferably in the nature of a unitary plastic squeeze bottle of a bellows type, formed as one-piece by blow molding or injection molding techniques which are well known. The synthetic resinous material from which the container or bottle 12 is formed may be transparent or translucent to accommodate visual observation of the quantity of foamable liquid 34 contained therein at any point in time. The bottle 12 comprises a threaded neck 19 defining a neck aperture 20, the diameter of which is substantially smaller than any other part of the bottle or container 12. The bottle 12 also comprises a first hollow body portion 22 located directly adjacent the neck 19 defining an enlarged hollow interior 24 (FIG. 3) which becomes a foamable liquid reservoir when the foamer 10 is inverted, as illustrated in FIG. 2.

Figure 2:
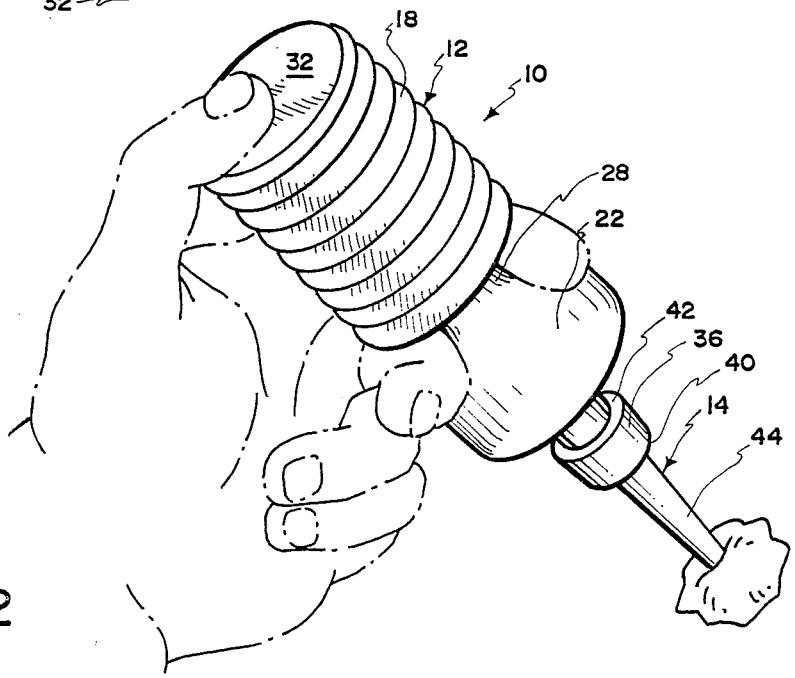
FIG. 2 is a reduced size perspective view of the assembled foamer in the inverted, as-used position.
Figure 3:
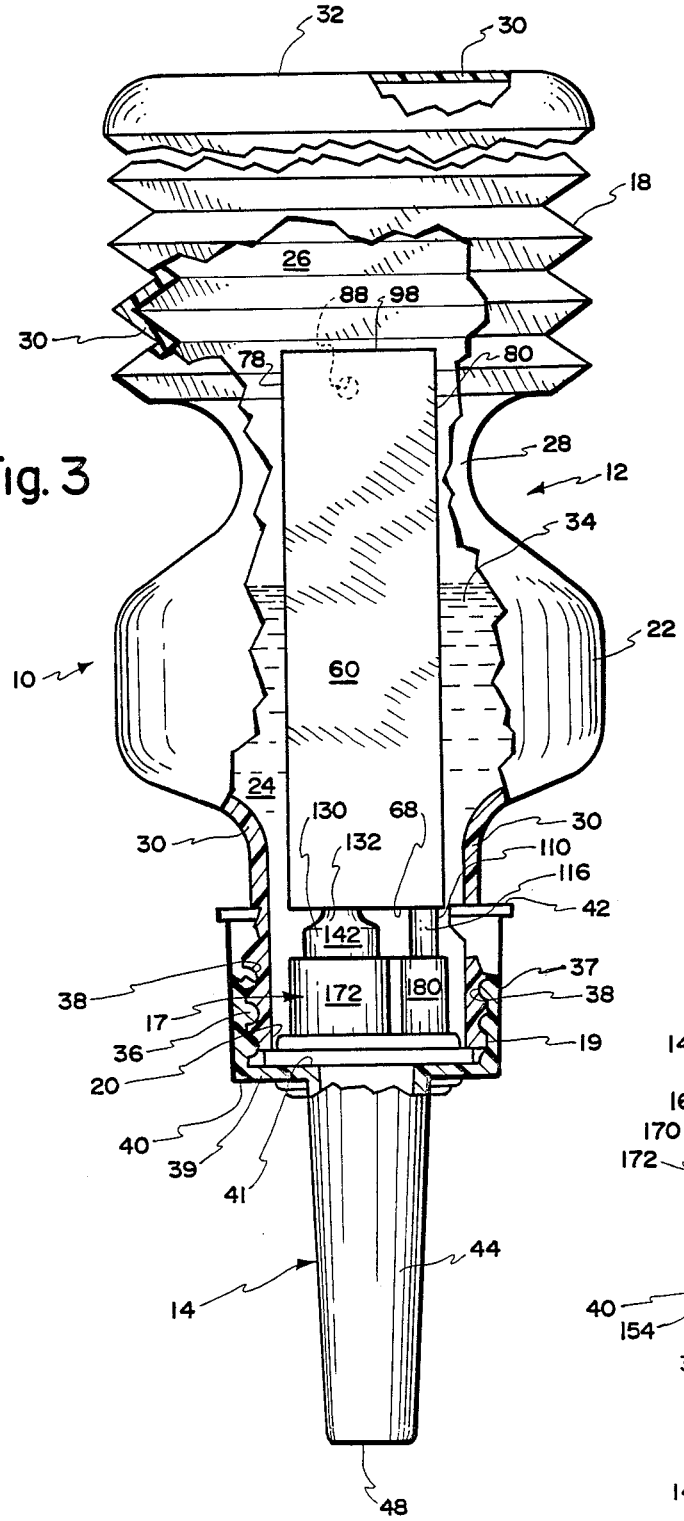
FIG. 3 is a side elevational view of the foamer of FIG. 1, with parts broken away for clarity of illustration.

The container 12 also comprises a second hollow body portion 18 defining an enlarged interiorly hollow bellows air pump cavity 26 (FIG. 3). The container 12 is diametrally reduced between portions 18 and 22 at a necked down central location 28 to accommodate manual grasping of the central location 28 by the user between the index and middle fingers with the thumb disposed at the end of bellows portion 18, as illustrated in FIG. 2.

The bottle or container 12 is illustrated as comprising a relatively thin wall 30 (FIG. 3) essentially of uniform thickness throughout its length, which thickness is sufficient to allow repeated use of the foamer 10 without causing a failure of the wall 30. Preferably, the container 12 is formed of a suitable synthetic resinous material with memory so that the bellows section 18 may be partially collapsed and expanded, due to the memory of the material comprising bottle 12, on a repeated basis without causing fatigue of the material. A medical grade polyethylene is satisfactory, as is polypropylene. The end 32 of the container 12 opposite the neck 18 constitutes an integral closure of bellows section 18 which comprises a continuation of the wall 30.

As explained herein in greater detail, in the inverted, as used position, illustrated in FIGS. 2 and 3, the air contained within chamber 26 is compressed and displaced as the bellows section 18 is compressed by force applied by the users thumb (FIG. 2).

It is intended, during periods of nonuse, that the foamer 10 be positioned such that the neck 19 is in an upwardly-directed position and that the foamer 10 rests upon the closure surface 32. This will cause the foamable liquid 34 within the container 12 to be disposed within the bellows section 18 and air in the bellows section 22.

While not critical, in one presently preferred embodiment of the present invention, the container 12 is sized to accommodate receipt of about $2\frac{1}{2}$ fluid ounces of foamable liquid 34, the liquid occupying slightly less than one-half of the hollow interior of the container 12. Other bottle sizes can be used.

Figure 4:
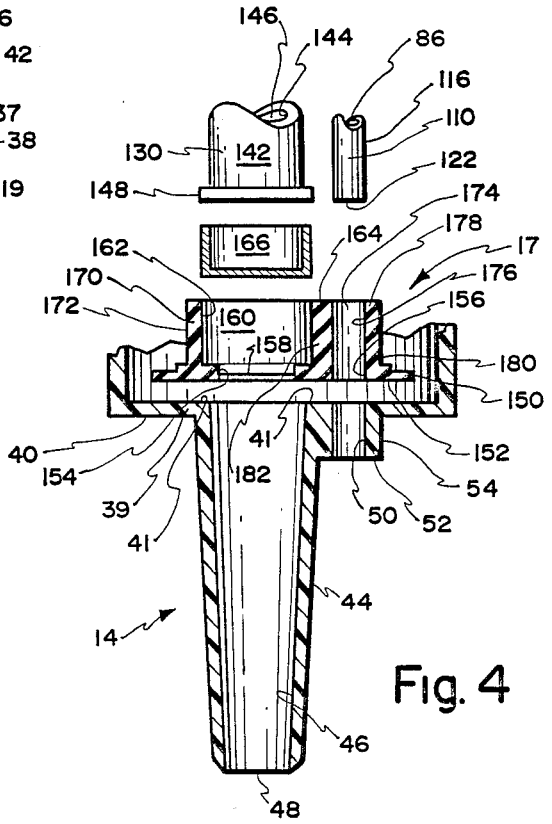
FIG. 4 is an enlarged fragmentary exploded side cross-sectional view of the foam dispensing nozzle.

With reference to FIGS. 1 and 4, the foam dispensing nozzle 14 is hollow throughout its length and comprised of a tapered spout 44 and a cap portion 36, which comprises internal threads 38 that match the external threads at neck 19 of the bottle 12 so that when the cap 36 is threaded upon the neck 19 a sealed connection is established, as best illustrated in FIG. 3. The longitudinal length of cap 36 from the distal face 40 of the front abutment wall 39 to the exposed blunt proximal edge surface 42 is slightly greater than the length of the threads disposed upon neck 19. The outside, longitudinally-directed surface 37 of cap 36 is illustrated as being annular.

The nozzle 14 is preferably formed as one piece using conventional injection molding techniques whereby the cap 36 is integral with the tapered spout 44. The spout 44 comprises a conically tapered internal passageway formed within the wall 44, shown to be of uniform thickness throughout, with one exception mentioned hereafter. The conical passageway 46 runs from the wall 39, at the interior abutment surface 41 thereof, to the proximal tip 48 of the spout. The nozzle 14 also comprises a relatively short air influent port 50, shown as being of uniform diameter throughout running from the abutment wall surface 41 to an edge 52, illustrated as being about one-fifth the length of the foam dispensing spout 44. The passageway 50 is disposed within a Cylindrical wall 54.

Figure 5:
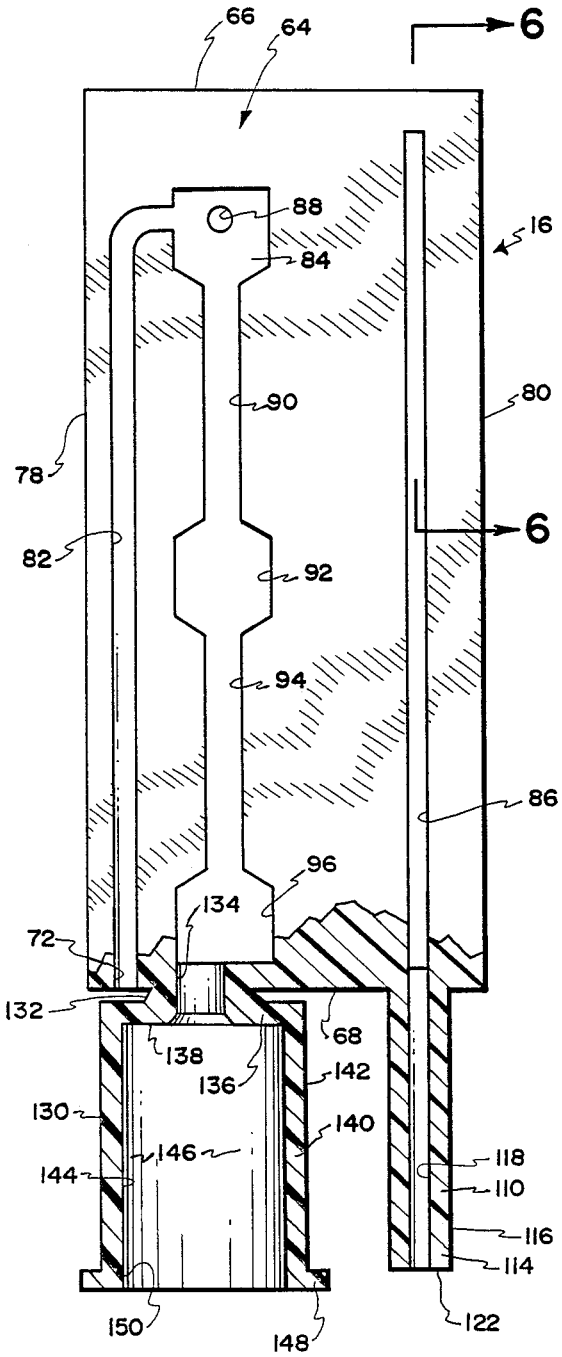
FIG. 5 is a longitudinal cross-section of the internal labyrinth structure of the foamer of FIG. 1.

The internal labyrinth structure 16 can best be understood by reference to FIGS. 1 and 5. Labyrinth structure 16 broadly comprises two laminated layers 60 and 64, layer 60 being preferably a rectangular layer of strong thin synthetic resinous film material, such as Mylar, polypropylene or the like. Layer 64 comprises a thicker block or plate also preferably of synthetic resinous material. Plate 64 has certain internal passageways, slots or grooves contained therein for accommodating flow of air, foamable liquid and foam, as hereinafter more fully explained. These passageways may be machined part way into a solid piece of plastic formed to comprise plate 64 or, in the alternative, plate 64 may be formed using existing injection molding technology. The present invention does not preclude use of a layer of film on each side of the plate 64 with some or all of the slots in plate 64 extending laterally entirely though the material comprising plate 64.

Plate 64 comprises a proximal edge surface 66 at one end thereof and a distal edge surface 68, which surfaces are disposed, in the assembled position, essentially normal to the axis of the container 12. Distal surface 68 is interrupted by relatively small foamable liquid influent port 72.

The plate 64 comprises opposed side edges 78 and 80, which are illustrated as being parallel one with the other and with the axis of the container 12, being disposed at essentially 90° to the proximal and distal end surfaces 66 and 68. In the illustrated form, side surfaces 78 and 80 are flat, smooth and uninterrupted. In one presently preferred embodiment which has been tested, it has been found suitable for plate 64 to be formed so that the distance between walls 78 and 80 is on the order of 11/16ths of one inch. A thickness, i.e. the distance front to back across each surface 66, 68, 78 and 80 is on the order of $\frac{1}{4}$ of one inch is satisfactory and a length from surface 66 to surface 68 of about $2\frac{7}{8}$ths inches is suitable. Of course, these dimensions are not critical and dimensionally different configurations can be produced without departing from the spirit of the present invention.

With specific reference to FIG. 5, which shows the plate 64 in front elevation with plastic layer 60 removed thereby exposing foamable liquid, air intake and foam forming and dispensing passageways and cavities contained within plate 64. Port 72 communicates into an L-shaped passageway 82, through which foamable liquid 34 (FIG. 3) flows to reach a foaming site 84, when the assembled foamer 10 is placed in the inverted position and held as illustrated in FIG. 2 with pressure applied to the surface 32 by the thumb of the user.

Influent air passageway 86 accommodates selective entry of air from the atmosphere into the interior of the container across a pressure flap valve 100 located adjacent the end 76 of the passageway 86. This occurs after foam has been produced and discharged (by manually collapsing the bellows section 18 in the manner illustrated in FIG. 2) and, after, the thumb is removed leaving a vacuum pressure in space 26 (FIG. 3) of the container 12. The described flow by which the air within the container 12 is equilibrated to atmospheric pressure occurs across valve 100 formed by plastic film layer 60, as hereinafter more fully explained. This plastic film valve also closes to prevent air flow in either direction when an external manual force is being applied in the manner illustrated in FIG. 2. This prevents air within the container 12 from being evacuated therefrom through passageway 86, whereby foam production and extrusion are accommodated.

When the foamer 10 is inverted and force applied as illustrated in FIG. 2, the pressurized air within space 26 (FIG. 3), caused by progressive collapsing of the bellows of section 18, is delivered to the foaming site or chamber 84 through a relatively small, precisely formed aperture 88, placed in the plate 64 between exterior surface 103 and chamber 84. The aperture 8 is sized so as to precisely control the amount and turbulence of air introduced as a stream into the foamable liquid flowing from passageway 82 into foaming chamber 84. The pressure of air introduced through aperture 88 must be adequate to produce the turbulence necessary and to provide the quantity of air needed to generate a foam having a lather density sufficient for use in medical, industrial and household applications. While only one aperture 88 is illustrated, it should be readily apparent that more than one aperture could be used so long as the proper ratio of foamable liquid to air is attained and the requisite turbulence in chamber 84 needed to create high quality foam occurs, in a manner well known in the foamer art.

With the foamer 10 inverted and with force being applied thereto as illustrated in FIG. 2, the foam, created in chamber 84, is displaced seriatum through passageway 90, enlarged chamber 92, where further mixing of the foam occurs, passageway 94 and enlarged chamber 96, where still further mixing of the foam occurs. Chambers 92 and 96 also prevent back flow of foam. While the enlarged chambers 92 and 96 are presently preferred, in order to thoroughly mix the foam, they may be eliminated and foam displaced from the foamer 10 through a passageway having a substantially uniform cross-section.

Figure 6:
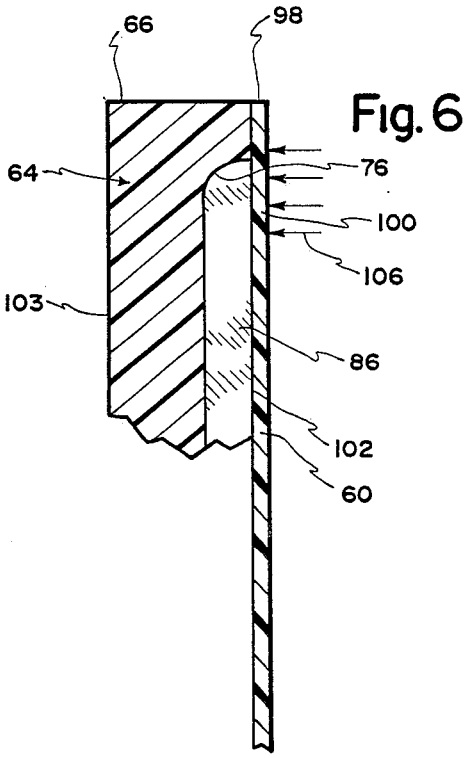
FIG. 6 is a fragmentary cross-sectional view taken along line 6—6 of FIG. 5, illustrating the influent air flap valve closed due to positive internal air pressure.
Figure 7:
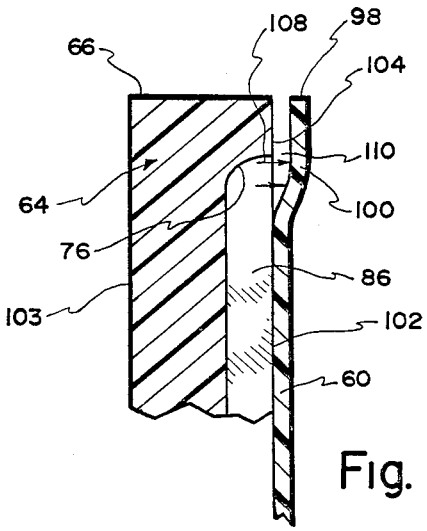
FIG. 7 is a view similar to FIG. 6, but illustrating the flap valve open due to negative internal air pressure.

As mentioned earlier, the plate 64 is preferably formed as a solid single piece of suitable synthetic resinous material, preferably polypropylene, to which the plastic film layer 60 is adhered, preferably by use of conventional heat sealing techniques. In the preferred embodiment, with reference to FIGS. 6 and 7, film layer 60 terminates at edge 98 and is secured at corner site 100. Restated, corner 100 of the film layer 60 is not attached or sealed to the back surface region 102 of the plate 64, at corner site 104 thereof (FIG. 7). When the interior of the container 12 is subjected to positive pressure during the foam-creating phase, this internal positive pressure (shown as arrows 106 in FIG. 6) will act upon the film layer 60 so that corner portion 100 thereof is pushed tightly and sealingly against the corner surface site 104 of the plate 64 thereby preventing discharge of air from the interior of the container 12 through passageway 86. See FIG. 6.

When the foam creating and discharging phase has been concluded and manual force is released from the exterior of the container 12, as mentioned earlier, a vacuum will then exist within the interior of container 12. Restated, atmospheric pressure at this juncture is greater than the interior pressure within container 12 and, consequently, the atmospheric pressure (illustrated as pressure arrows 108 in FIG. 7) will displace corner portion 100 of the film layer 60 away from the surface area 104 of plate 64 so that atmospheric air, present in passageway 86, enters the interior of the container 12, via the opening 110 (FIG. 7) created between film corner region 100 and surface area 104. This continues until the pressure within the container 12 equals atmospheric pressure.

Referring once more to FIG. 5, it is to be observed that an influent air flow accommodating coupling tubular projection 110, forming part of plate 64, is disposed in alignment with and extends passageway 86. Tubular projection 110 is cylindrical in form comprising an annular wall 114 comprising external cylinder surface 166 and internal cylindrical surface 118. Surface 118 defines a continuation of the passageway 86, which is of uniform diameter throughout its length. Tubular projection 110 comprises a blunt transverse edge 122 and is of a length such that it bridges between surface 68 and a seated association with the coupling member 17, as hereinafter more fully described. Restated, tubular projection 10 spans between the distal end 68 of the plate 64 and the proximal end of the coupling 17, whereby influent or replacement air flow to the interior of the container 12 is accommodated at the appropriate point in time, in the manner described above.

Similarly, an effluent foam displacement-accommodating enlarged tubular piece 130, formed integral with plate 64, bridges between the distal surface 68 of the plate 64 and the coupling member 17 to accommodate displacement of the foam, received from chamber 96, through the tubular projection 130 to foam effluent spout 44. Tubular projection 130 comprises a conical surface 132. Tubular projection 130 comprises a small interior bore 134, the diametral size of which is illustrated as being approximately one-half the width of the chamber 96. Tapered surface 132 merges with transverse wall 136 which defines an interior annular shoulder 138. Transverse wall 136 merges with a cylindrical longitudinally-directed wall 140 of uniform thickness comprising internal and external cylindrical surfaces 142 and 144. The diameter of the surface 144 is illustrated as being on the order of three times that of the diameter of passageway 134. Consequently, the rate of displacement of foam issuing through passageway 134 into enlarged interior chamber 146 slows. Cylindrical wall 140 merges with a short radially-directed flange 148, disposed directly adjacent the exit port 150 from chamber 146.

Preferably, connectors 110 and 130 are essentially rigid and formed respectively of one-piece construction using conventional injection molding techniques from a satisfactory synthetic resinous material, such as polypropylene.

The coupling member 17 preferably comprises polyvinyl chloride and preferably is formed as one piece using known injection molding techniques. Coupling member 17, as best illustrated in FIG. 4, comprises a base plate or distal flange 150 defining a smooth lower base surface 152. Base flange 150 has a diameter which is greater than the interior aperture 20 of neck 19 of container 12 and less than the interior diameter of the internal threads 38 of the cap 36 of the nozzle piece 14 so that the flange 150 may be interposed and compressively retained between the distal edge of neck 19 of the container 12 and the wall surface 41 of the nozzle 14 as illustrated in FIG. 3, when the foamer is fully assembled.

The base flange 150 of the coupling member 17 is interrupted by spaced ports 154 and 156. A slender plastic beam 158 spans across the port 154. Port 154 accommodates egress displacement of foam to the effluent foam spout passageway 46. Adjacent to the port 154 is a cylindrical chamber 160, defined by an annular surface 162, the diameter of which is slightly greater than the diameter of the port 154. Chamber 160 terminates at proximal edge surface 164 of the coupling member 17. A cup-shaped gauze filter 166 is sized and shaped so as to accommodate firm contiguous placement within the chamber 160. Foam passing through the porous gauze filter 166 is homogenized. As illustrated in FIG. 4, the vertical distance of gauze filter 166 is less than the vertical distance of the chamber 160. The flanged end 148 of the tubular projection 130 is force-fit into the filter 166 after the filter 166 is in place within the chamber 160. This holds the filter in its assembled location. Beam 158 prevents extrusion of the filter 166 into spout passageway 46.

Foam emerging from chamber 146 of the tubular projection 130 flows into the chamber 160, through the filter 166, across the port 154 and out the passageway 46 of the spout 44 to the user.

The annular surface 162, which defines the chamber 160, is part of a cylindrical wall 170. The wall 170 also comprises an external cylindrical exterior surface 172. The second port 156 in the flange 150 of the coupling member 17 communicates with a passageway 174. Passageway 174 is defined by an annular wall 176 of uniform diameter throughout, which surface 176 comprises part of wall 178. Wall 178 comprises an exterior cylindrical surface 180. Walls 178 and 170 merge to form interior wall 182, disposed between chamber 160 and passageway 174. The tubular projection 110, beginning at distal edge 122 is force-fit into the passageway 174 whereby influent air may pass only through passageway 50, passageway 174, the interior passageway 86 and out through the opening 110 (FIG. 7) at the flap valve 100 when vacuum conditions exist within the interior of the container 12. It should be noted that polyvinyl chloride, from which the coupling member 17 is preferably formed, is yieldable to the more rigid materials from which tubular projections 110 and 130 are formed and the respective diameters are sized so that the walls 170, 176 and 182 forming chambers 160 and passageway 174 are slightly dilated by the insertion of the tubular projections 110 and 130 whereby the memory from which the material of coupling member 17 is formed will exert radial pressure forces upon the inserted ends of tubular projections 110 and 130 so as to seal and hold those ends in the assembled positions, best illustrated in FIG. 3.

The invention may be embodied in other specific forms without department from the spirit or essential characteristics thereof. The present embodiment, is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. An invention hand-held foamer comprising:

an externally exposed container comprising a hollow interior in which air and a supply of foamable liquid are concurrently disposed, wall means which are selectively manually collapsible to compress the air and thereby displace foamable liquid and air and a port at one end of the container;

a labyrinth carried within the interior of the container and the port thereof, the labyrinth comprising air, foamable liquid and foam flow path-defining cavities placed in a common body, said cavities being covered by a layer placed over said common body, the cavities comprising (a) a foamable liquid entry within the interior of the container juxtaposed the port and a foamable liquid flow path disposed within the labyrinth to which foamable liquid entering through the entry is delivered, (b) means for replenishing air into the container comprising an air entry disposed at the port of the container in communication with atmospheric air, an air flow path and a valved means for discharging air disposed centrally adjacent air above the foamable liquid remote from the port within the interior of the container when the foamer is inverted so that the port is downwardly directed, (c) a foam producing chamber within the body disposed centrally adjacent air within the interior of the container when the foamer is inverted so that the port is downwardly directed, (d) air-to-foamable liquid intake means interposed between air within the central interior of the container when the foamer is inverted so that the port is downwardly directed and the foam-producing chamber whereby air of sufficient quantity and turbulence is infused through the air-to-foamable liquid intake means into the flow of foamable liquid into the foam-producing chamber for creation of foam when the foamer is inverted and manually pressurized, and (e) a foam flow path extending from the foam-producing chamber to a foam discharge outlet located adjacent the port by which foam is communicated from the foamer to a user.

2. An inversion hand-held foamer comprising:

an externally exposed container comprising a hollow interior in which air and a supply of foamable liquid are concurrently disposed, wall means which are selectively manually collapsible to compress the air and thereby displace foamable liquid and air and a port at one end of the container;

a labyrinth carried within the interior of the container and the port hereof, the labyrinth comprising a lamina defining a unitary labyrinth body having air, foamable liquid and foam flow pat-defining cavities disposed at least in part in the unitary labyrinth body said cavities being covered by an exterior layer the cavities defining (a) a foamable liquid entry located within the interior of the container juxtaposed the port and a foamable liquid flow path extending from the foamable liquid entry to a location above the foamable liquid within the interior of the container (b) means for replenishing air into the container comprising an air entry disposed at the port of the container in communication with atmospheric air, an air flow path and valved for discharging means air disposed centrally adjacent air above the foamable liquid remote from the port within the interior of the container when the foamer is inverted so that the port is downwardly directed, (c) a foam-producing chamber disposed centrally adjacent air within the interior of the container when the foamer is inverted so that the port is downwardly directed, (d) air-to-foamable liquid intake means located between air within the central interior of the container, when the foamer is inverted so that the port is downwardly directed, and the foam-producing chamber in the labyrinth body whereby air of sufficient quantity and turbulence is infused through the air-to-foamable liquid intake means into the flow of foamable liquid into the foam-producing chamber for creation of foam when the foamer is inverted and manually pressurized, and (e) a foam flow path extending from the foam-producing chamber to a foam discharge outlet located adjacent the port by which foam is communicated from the foamer to a user.

3. An inversion hand-held foamer comprising:

an externally exposed container comprising a hollow interior in which air and a supply of foamable liquid are concurrently disposed, wall means which are selectively manually collapsible to compress the air and thereby displace foamable liquid and air and a port at one of the container;

a labyrinth carried within the interior of the container and the port thereof, the labyrinth comprising a lamina defining a relatively thick unitary body having air, foamable liquid and foam flow path-defining cavities disposed at least in part in the unitary body and a relatively thin flexible sheet selectively covering the cavities, the cavities defining (a) a foamable liquid entry within the interior of the container juxtaposed the port and a foamable liquid flow path extending from the foamable liquid entry to a location above the foamable liquid within the interior of the container (b) means for replenishing air to the container comprising an air entry disposed at the port of the container in communication with atmospheric air, an air flow path and valved means for discharging air disposed centrally adjacent air above the foamable remote from the port within the interior of the container when the foamer is inverted so that the port is downwardly directed, (c) a foam-producing chamber centrally adjacent air within the interior of the container when the foamer is inverted so that the port is downwardly directed, (d) air-to-foamable liquid intake means located between air within the container and the foam-producing chamber when the foamer is inverted whereby air of sufficient quantity and turbulence is infused through the air-to-foamable liquid intake means into the flow of foamable liquid into the foam-producing chamber for creation of foam when the foamer is inverted and manually pressurized, and (e) a foam flow path extending from the foam-producing chamber to a foam discharge outlet located adjacent the port by which foam is communicated from the foamer to a user.

4. An inversion hand-held foamer according to claim 3 wherein the flexible sheet extends substantially continuously within the container from adjacent the port to a site where air exists above the foamable liquid when the foamer is inverted and the valved means for discharging air comprises an unattached area of the sheet adjacent the interior end of the air flow path adjacent air above the foamable liquid when the foamer is inverted which closes when interior air pressure is greater than atmosphere and which opens when interior air pressure is less than atmosphere.

5. An inversion hand-held foamer according to claim 3 wherein the flexible sheet comprises a high strength synthetic resinous film.

6. An inversion hand-held foamer according to claim 5 wherein the high strength synthetic resinous film comprises Mylar.

7. An inversion hand-held foamer according to claim 3 wherein the sheet is heat seal-connected to the interior body.

8. An inversion hand-held foamer according to claim 3 wherein the foam flow path comprises a substantially enlarged cross-sectional area of a portion of the cavities within the unitary body downstream of the foam-producing chamber but remote from the port.

9. An inversion hand-held foamer according to claim 3 wherein the foam discharge outlet comprises a foam-discharge nozzle disposed adjacent the port of the container.

10. A fluid flow control valve mechanism for placement within a compressible invertible hollow housing, said housing having an opening and a port at the opening, and air and liquid within said housing disposed where the internal air pressure varies from above to below atmospheric pressure, the valve mechanism comprising an air influent passageway comprising a flow path disposed in a body extending from adjacent the port to a central location int eh housing in the air above the liquid when the housing is inverted and a sheet generally sealingly covering selected faces of the body from adjacent the port to said central location, the flow path opening to the atmosphere at the distal end thereof adjacent the port and comprising a proximal end at said central location, the sheet comprising an unattached area thereof adjacent the proximal end of the flow path at said central location which closes against the body at the central location when the internal air pressure within the housing is greater than atmosphere and which opens away from the body at the central location where the internal air pressure within the hollow housing is less than atmosphere.

* * * * *